US007779662B2

(12) United States Patent
Muschalik

(10) Patent No.: US 7,779,662 B2
(45) Date of Patent: Aug. 24, 2010

(54) EXTRUDER AND PIPE EXTRUDER

(75) Inventor: Uwe Muschalik, Duisburg (DE)

(73) Assignee: SMS Eumuco GmbH, Leverkusen (DE)

( * ) Notice: Subject to any disclaimer, the term of this patent is extended or adjusted under 35 U.S.C. 154(b) by 417 days.

(21) Appl. No.: 11/663,658

(22) PCT Filed: Sep. 6, 2005

(86) PCT No.: PCT/DE2005/001551

§ 371 (c)(1),
(2), (4) Date: Dec. 27, 2007

(87) PCT Pub. No.: WO2006/032235

PCT Pub. Date: Mar. 30, 2006

(65) Prior Publication Data

US 2008/0127702 A1 Jun. 5, 2008

(30) Foreign Application Priority Data

Sep. 22, 2004 (DE) ..... 10 2004 046 229

(51) Int. Cl.
*B21C 27/00* (2006.01)

(52) U.S. Cl. ..... 72/272; 72/253.1

(58) Field of Classification Search ..... 72/253.1, 72/272, 273.5

See application file for complete search history.

(56) References Cited

U.S. PATENT DOCUMENTS 2,735,545 A * 2/1956 Norman ..... 72/272
2,830,701 A * 4/1958 Kent ..... 72/263
3,070,391 A * 12/1962 Hofmann ..... 403/18
3,352,141 A * 11/1967 Boshold ..... 72/272
4,694,673 A * 9/1987 Boshold ..... 72/272
5,855,135 A 1/1999 Howe
7,216,522 B2 * 5/2007 Gala ..... 72/253.1

FOREIGN PATENT DOCUMENTS

DE 644174 A 5/1934
GB 1 287 892 9/1972
WO 04/000538 * 12/2003
WO 04000538 A3 12/2003

* cited by examiner

*Primary Examiner*—Edward Tolan
(74) *Attorney, Agent, or Firm*—Andrew Wilford

(57) ABSTRACT

The invention relates to an extruder and pipe extruder (1), comprising a press frame (3) consisting of a cylinder bar and a counter bar (2) connected thereto, wherein a linear displaceable receiver carriage (5) is arranged, said carriage consisting of a receiver holder (6) which concentrically encompasses a block receiving element (7) and transports a block, which is charged with a charging device and which is to be pressed in a press position in front of a die associated with the counter bar (2), wherein the receiver holder (6) is maintained therein in a self-supporting manner in relation to the receiver carriage by means of air (2). The receiver holder (6) is provided with carrier webs (13) which are arranged on two sides in the middle of the press (12) and which project in a diametrically outward manner, being suspended in the recesses (14) of retaining blocks (15) of the receiver carriage (5).

3 Claims, 1 Drawing Sheet

EXTRUDER AND PIPE EXTRUDER

CROSS REFERENCE TO RELATED APPLICATIONS

This application is the US national phase of PCT application PCT/DE2005/001551, filed 6 Sep. 2005, published 30 Mar. 2006 as WO 2006/032235, and claiming the priority of German patent application 102004046229.1 itself filed 22 Sep. 2004.

FIELD OF THE INVENTION

The invention relates to a rod and tube extruder comprising a press frame formed by a cylinder beam and a counter beam connected thereto in which a linearly displaceable holder carriage is provided, the holder carriage having a holder that concentrically encloses a billet gripper and transports a billet that is introduced by means of a loader and that is to be pressed in a press position in front of a die associated with the counter beam, the holder being held therein by air in a self-supporting manner with respect to the holder carriage.

BACKGROUND OF THE INVENTION

Such an extrusion press is known from DE 20 03 244 A (GB 1,287,892). The holder together with the billet gripper or receptacle is supported in a yoke so as to be pivotable about a vertical axis. However, it is still possible for the billet gripper to become misaligned with the die and the pressing stamp, so that extrusion of the billet is hindered or even impossible. To allow adjustments to be made to the central axis, the entire holder carriage can be adjusted and set in the vertical direction by means of screws, and in the transverse, i.e. lateral, direction by adjusting the slide webs for the holder carriage.

In one extrusion press known from DE 195 00 555 C1 (U.S. Pat. No. 5,855,135), the charging into the billet gripper (not described) of a billet to be pressed is usually performed by transferring a billet, preheated in a furnace to the pressing temperature, into loading trays and, using swivel arms mounted to a shaft in a rotationally fixed manner—referred to as swivel loaders, as an alternative to linear billet loaders that are also commonly used—swiveling it in the press axis into the unoccupied space between the die and the press plate. By use of adjusting cylinders a running beam and the holder carriage that is movable on the guides of the press frame may be displaced on the die or the counter beam, the billet gripper being inverted above the billet. Corresponding to the advancement of the holder carriage together with the billet gripper, the axially movable swivel arm is moved on the shaft until the billet is clamped between the pressing stamp or mandrel and the counter beam or die fastened in a holder. The holder carriage is moved by means of lateral cylinders.

During the extrusion pressing, high compression stresses are present in the billet that allow a high degree of deformation. A prerequisite for this high degree of deformation is a low yield stress of the material being shaped. For this reason pressing is performed only at high temperatures. For aluminum materials the pressing temperature is 400 to 500° C., for copper materials, 600 to 900° C., and for stainless steel or special materials, up to 1250° C. The thermal expansion unavoidably associated with these high temperatures makes it very difficult to maintain the central position of the billet gripper with respect to the press axis.

From previously cited DE 195 00 555 C1 it is known to support the holder and running beam on support surfaces that are angled in such a way that their extension intersects the press axis or is close thereto, thus being oriented to the press axis, in order to prevent the central position of the receiver and the pressing stamp from being influenced by thermal expansion caused by changes in temperature. For central alignment of the receiver and the pressing stamp on the press axis, for the base frames that support the guides for the holder carriage together with the holder and the running beam, supports are provided between the guides and base frame that are horizontally adjustable on the base frame transverse to the press axis, and with respect to which the guides are vertically adjustable.

OBJECT OF THE INVENTION

The object of the present invention is to provide in a generic rod and tube extruder a configuration of the billet gripper or holder in the holder carriage that in a simple manner prevents thermal expansion from interfering with the central position of the billet gripper with respect to the press axis.

SUMMARY OF THE INVENTION

This object is achieved by the invention by providing the holder with support webs, situated on both sides at the center of the press and projecting diametrically outward and that are suspended in recesses in retaining blocks for the holder carriage. The holder that is separately supported according to the invention thus rests on the holder carriage only on narrow contact surfaces of the support webs, i.e. fins, lugs, or the like, in the retaining blocks. The holder together with the billet gripper is thermally decoupled from the holder carriage. The casing of the billet gripper is able to expand in the holder without the varying temperature of the holder affecting the central position of the billet gripper that is located in the holder carriage, unchanged at the center of the press.

The narrow support webs or the like are negligible for the thermal effect, and have play for heat-related expansion in the vertical U-shaped recesses that are open at the end.

According to one embodiment of the invention, the self-supporting bearing or retaining of the holder in the holder carriage may be set by screwing the retaining blocks to hold-down plates placed on top, the screw connections extending alongside the recesses in the retaining blocks.

In one preferred embodiment of the invention, the holder is supported by an axial ridge, perpendicular to the center of the press, provided in a slot in a base support of the holder carriage. As a sort of bridge member, the base support connects the holder carriage comprising guide shoes that are provided on both sides of the holder and that run on linear guides in the press frame. In cooperation with the support webs, the axial ridge, which has likewise has a very narrow, optionally fin-shaped design, allows the billet gripper to be precisely supported and guided, i.e. centrally positioned, in both the horizontal and vertical planes. Here as well, the axial ridge, fin, or the like is negligible for the thermal effects.

BRIEF DESCRIPTION OF THE DRAWING

Further features and particulars of the invention result from the claims and the following description of one illustrated embodiment illustrated in the drawings, wherein:

SPECIFIC DESCRIPTION

Figure 1:
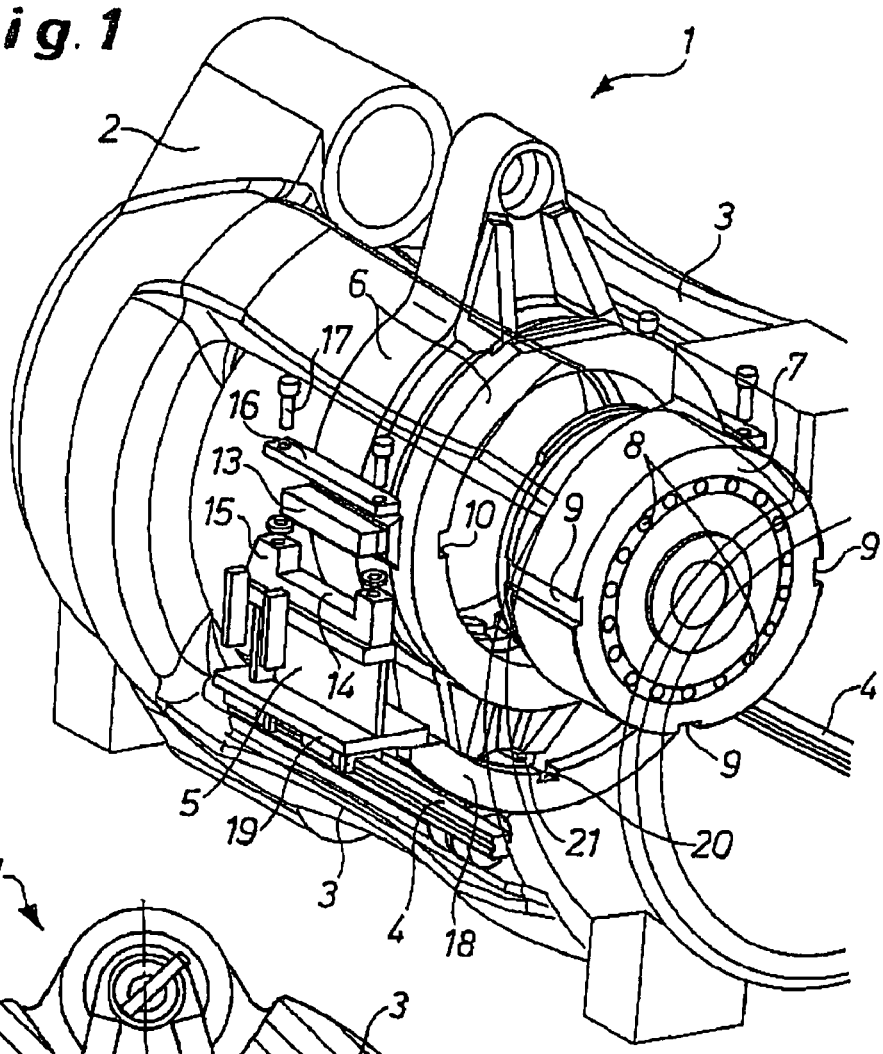
FIG. 1 is a partial longitudinal view of an extrusion press in a perspective exploded illustration.

FIG. 1 shows essentially only a counter beam 2 connected via a compact press frame 3 to the cylinder beam, and a holder carriage 5 mounted in front of same and displaceable on linear guides 4 in the press frame 3 together with the holder 6 and billet gripper 7 (also see FIG. 2) of a metal extrusion press, i.e. rod and tube extruder 1 known per se. The billet gripper 7 has numerous heating rods 8 for maintaining the temperature of a loaded billet that has been preheated in a furnace.

Figure 2:
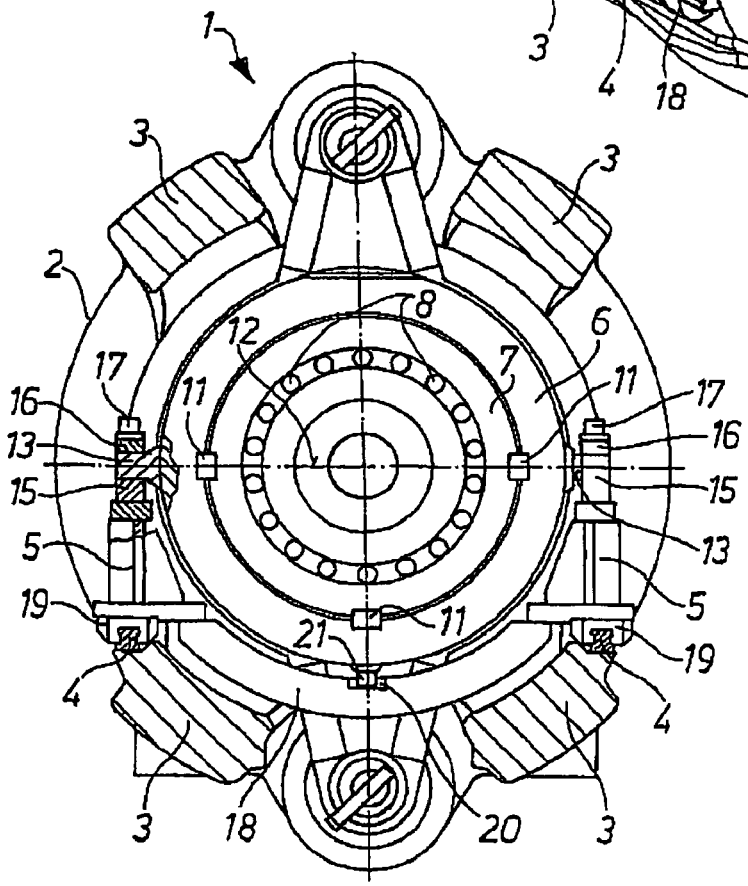
FIG. 2 is a cross section of the extrusion press according to FIG. 1.

The billet gripper 7 has axial grooves 9 that in the installed position align with axial grooves 10 in the holder 6, so that the billet gripper 7 may be fixed in place in the holder 6 by means of fitted splines 11 (see FIG. 2). The holder 6 that thus concentrically encloses the billet gripper 7 is held in a self-supporting manner, set off at a spacing, i.e. by air, from the holder carriage 5. For this purpose the holder 6 has small, narrow support webs 13, provided on both sides of the center of the press and projecting diametrically outward and inserted in recesses 14 of U-shaped retaining blocks 15 (see FIG. 1) for the holder carriage 5 and thus having only small contact surfaces with respect to the holder carriage 5. To fix the support webs 13 that are inserted in the U-shaped recesses 14, hold-down plates 16 are mounted on the retaining blocks 15 from above and are fastened thereto by screws 17.

The holder carriage 5, whose parts on both sides are connected to one another by a bridging base support 18, runs along the linear guides 4 on guide shoes 19. An axial slot 20 (also see FIG. 1) is provided in the base support 18, perpendicular to the center of the press 12, in which a narrow, fin-like axial ridge 21 of the holder 6 engages. By means of the support webs 13 provided in the center of the press 12 as well as via the axial ridge 21, the holder 6 together with the billet gripper 7 is centered exactly in the center of the press in both the horizontal and vertical planes.

Due to the thermal decoupling resulting from the separated, self-supporting configuration of the holder 6 in the holder carriage 5, this central positioning remains unaffected by thermal effects. This is because the casing of the billet gripper 7 is able to expand unhindered on account of its separate mounting. Contact via the support webs 13 and the axial ridge 21 maintains this protection, since these elements have only small, narrow contact surfaces and the thermal effects are therefore negligible.

The invention claimed is:

1. A rod and tube extruder comprising:

a press frame formed by a cylinder beam and a counter beam connected thereto;

a holder carriage linearly displaceable in the press frame a holder;

a billet gripper concentrically surrounded by the holder and adapted to transport a billet that is introduced by means of a loader and that is to be pressed in a press position in front of a die associated with the counter beam, the holder being supported in and spaced from the holder carriage;

webs on both sides of the holder at the center of the press and projecting diametrically outward;

respective retaining blocks for the holder carriage forming inwardly open recesses in which the respective webs engage;

linear guides on the press frame; and respective guide shoes linearly shiftable along the guides and carrying the retaining blocks.

2. The rod and tube extruder according to claim 1, further comprising hold-down plates on top of and screwed down onto the retaining blocks.

3. The rod and tube extruder according to claim 1, wherein the holder is supported by an axial ridge fitted in a slot extending perpendicular to the center of the press in a base support of the holder carriage.

* * * * *